US005420383A

United States Patent [19]

Kousen et al.

[11] Patent Number: 5,420,383

[45] Date of Patent: May 30, 1995

[54] ANTI-SOUND ARRANGEMENT FOR MULTI-STAGE BLADE CASCADE

[75] Inventors: Kenneth A. Kousen, East Hartford; John C. Simonich, Glastonbury; Joseph M. Verdon, Vernon; Robert H. Schlinker, Canton, all of Conn.

[73] Assignee: United Technologies Corporation, Hartford, Conn.

[21] Appl. No.: 141,447

[22] Filed: Oct. 22, 1993

[51] Int. Cl.[6] ..... F01N 1/06

[52] U.S. Cl. ..... 181/206

[58] Field of Search ..... 181/206; 381/71; 415/119

[56] References Cited

U.S. PATENT DOCUMENTS

| | | | |
|---|---|---|---|
| 3,693,749 | 9/1972 | Motsinger et al. | 181/206 |
| 4,025,724 | 5/1977 | Davidson, Jr. et al. . | |
| 4,044,203 | 8/1977 | Swinbanks . | |
| 4,199,295 | 4/1980 | Raffy et al. | 415/115 |
| 4,255,083 | 3/1981 | Andre et al. | 415/119 |
| 4,419,045 | 12/1983 | Andre et al. | 415/119 |
| 4,689,821 | 8/1987 | Salikuddin et al. | 381/71 |
| 4,947,434 | 8/1990 | Ito | 381/71 |
| 4,967,550 | 11/1990 | Acton et al. | 60/39.29 |
| 5,005,353 | 4/1991 | Acton et al. | 415/419 X |
| 5,082,421 | 1/1992 | Acton et al. | 415/118 |
| 5,097,923 | 3/1992 | Ziegler et al. | 181/206 |
| 5,141,391 | 8/1992 | Acton et al. | 415/119 |

OTHER PUBLICATIONS

Unpublished report entitled "Active Control of Wake/Blade-Row Interaction Noise" by Kenneth A. Kousen and Joseph M. Verdon, United Technologies Research Center, East Hartford, CT prepared for Lewis Research Center under Contract NAS3-25425.

*Primary Examiner*—Khanh Dang
*Attorney, Agent, or Firm*—Troxell K. Snyder

[57] ABSTRACT

An arrangement for cancelling unwanted noise generated by sequential blade rows (16, 18) in a gas turbine engine (10) includes a plurality of acoustic sources (52) disposed on the blades (36–42) of the downstream row (18).

5 Claims, 3 Drawing Sheets

ANTI-SOUND ARRANGEMENT FOR MULTI-STAGE BLADE CASCADE

FIELD OF THE INVENTION

The present invention relates to an arrangement for reducing undesirable noise generation in one or more rotating blade stages.

BACKGROUND

Reduction of noise generation in rotating blade stages has long been sought by designers of axial flow compressors and gas turbine engines. In an axial compressor, air flows sequentially through a plurality of rotating and stationary airfoils, where it is accelerated and turned for the purpose of increasing its pressure.

The air flow exiting the rotating airfoils in an axial flow compressor defines a series of rotating velocity fluctuations at the entry plane of the downstream stationary airfoil row as the result of the moving wakes formed by the upstream airfoils. The wake velocity fluctuations striking the downstream stationary airfoils cause the whining, tonal noise which is especially prevalent during takeoff and approach for aircraft propulsion gas turbine engines. Stringent noise restrictions for airports and their surroundings have resulted in increased efforts by engine and aircraft manufacturers to reduce or eliminate noise generation by their products.

One technique for noise suppression is the employment of anti-sound generation whereby unwanted noise is eliminated by the generation of a cancelling sound pattern which is out of phase with the unwanted noise. This concept has proved difficult to use in practical application for the cancellation of complex noise signatures.

Due to the magnitude of the blade-wake interaction noise, as well as the complexity of the many acoustic modes which are generated by this interaction, prior art methods of gross field noise cancellation by the use of anti-sound generators and transducers are expected to be cumbersome and ineffective. What is needed is a simple arrangement of anti-sound generators and controls.

SUMMARY OF THE INVENTION

The present invention provides a means for reducing or eliminating the tonal noise caused by blade-wake interaction in a rotating blade stage flow arrangement. According to the present invention, a plurality of active acoustic sources are disposed on the exterior surface of the blades comprising the downstream row. The acoustic sources are driven to produce noise cancelling sound, thereby attenuating or eliminating the tonal noise globally by cancelling it at or near its source.

The acoustic sources are further mounted or located so as to isolate the downstream blades from mechanical vibration caused by the sources. According to mathematic modeling, maximum noise cancellation is achieved when the number of acoustic sources on each downstream cascade blade is equal to the number of individual acoustic modes present in the tonal noise.

It is a feature of the present invention to achieve tonal noise cancellation without significant variation or vibration of the physical configuration of the blades. Further, it is another feature of the present invention to achieve noise cancellation without significantly affecting the flow of the fluid into and through the downstream cascade. It is still further a feature of the present invention that any physical displacement of any vibrating surface of the acoustic sources is confined within a very small range.

DETAILED DESCRIPTION

Figure 1:
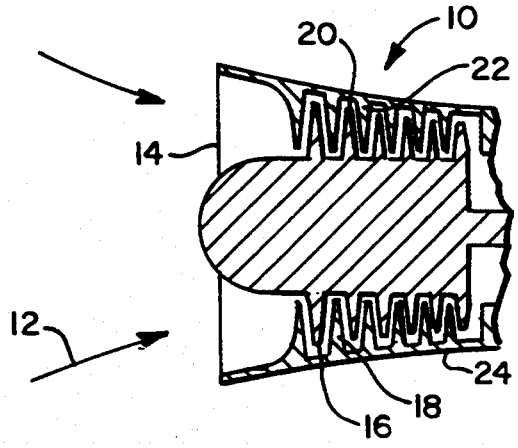
FIG. 1 PRIOR ART
FIG. 1 shows a partial cutaway cross-section of a compressor section of a gas turbine engine.

Referring to the drawings figures, and in particular to FIG. 1 thereof, a partial schematic view of a gas turbine engine 10 is shown. Incoming air 12 enters the engine inlet opening 14 and passes sequentially through alternating rotor and stator airfoils 16, 18, 20, 22, etc. Rotating airfoils 16, 20 are driven by the downstream turbine section. (not shown) while stationary airfoils 18, 22 are attached to the engine casing 24 or other non-rotating structure.

Figure 2:
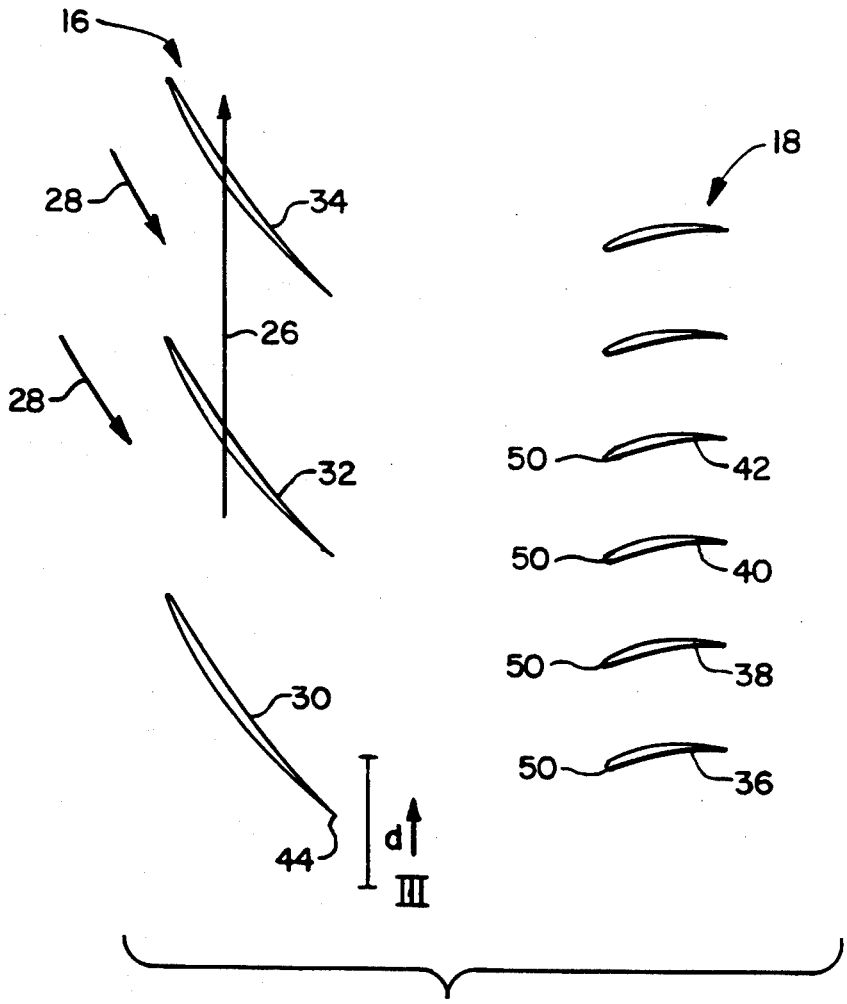
FIG. 2 PRIOR ART
FIG. 2 shows a schematic view of a portion of a rotating blade stage having two sequential blade rows.

In practice, the rotating and stationary airfoils 16–22 can be represented two dimensionally by a plurality of blade rows 16, 18 as shown in FIG. 2. Rotating row 16, representing the rotor compressor, is shown moving vertically 26 relative to the stationary stator row 18. Air or gas flow 28 entering the rotor stage 16 is accelerated by the moving blades 30, 32, 34, then enters the non-moving stator row 18 wherein the airflow is turned and slowed by the stator blades 36, 38, 40, 42. The turning and slowing of the airflow increases the static air pressure.

Figure 3:
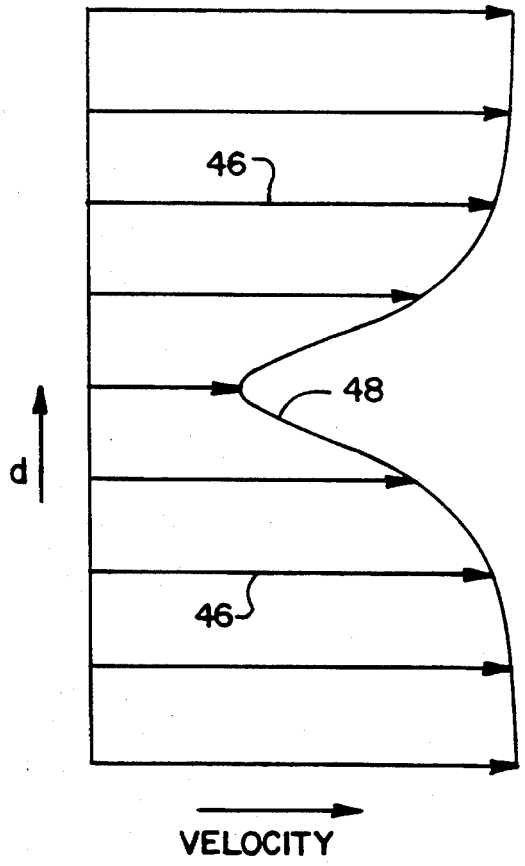
FIG. 3 PRIOR ART
FIG. 3 shows the variation in velocity resulting from the passage of the wake generated by the upstream blade as shown in FIG. 2.

FIG. 3 shows the variation in airflow velocity with regard to lateral displacement in the vicinity of the trailing edge 44 of the blade 30 as indicated in FIG. 2. As can be clearly seen in FIG. 3, the velocity vectors 46 experience a dip in magnitude 48 immediately downstream of tile trailing edge 44. As the row 16 moves 26, the velocity variations 48 of the individual blades 30 will cause a periodic pressure fluctuation at the leading edges 50 of the downstream blades 36–42.

Periodic fluctuation of velocity over the downstream row 18 results in the generation of an undesirable noise pattern typically having a plurality of tonal modes which are multiples of the blade passing frequency. It is the cancellation of the acoustic noise and modes that is the goal of the present invention.

Figure 5:
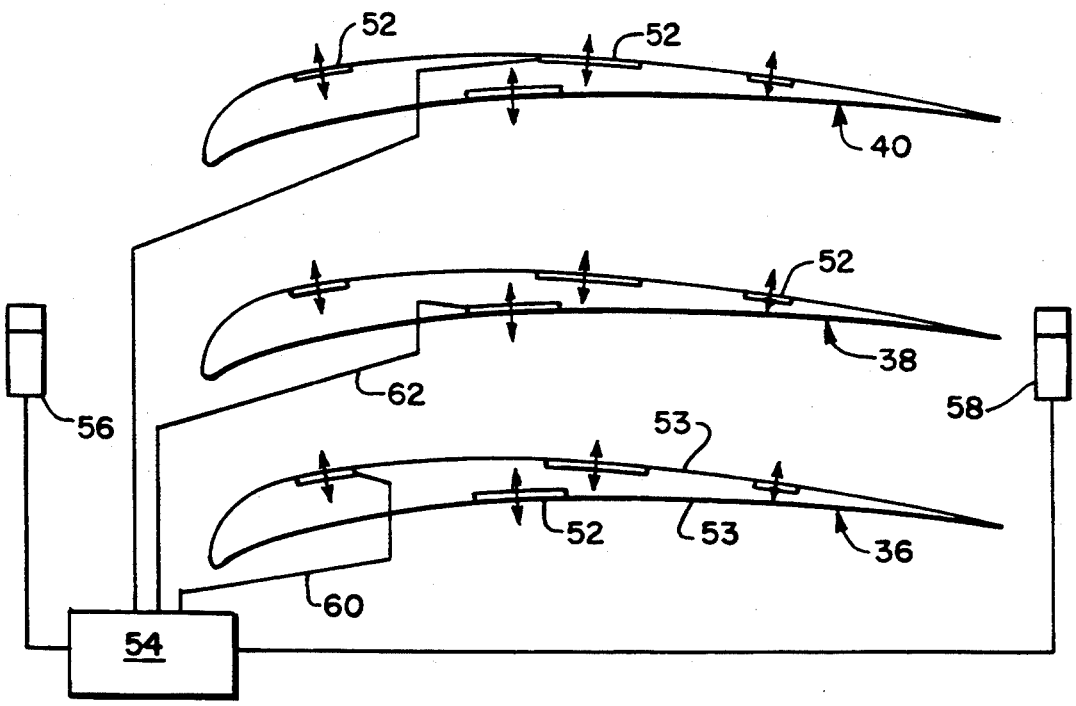
FIG. 5 shows a cross-sectional view of a portion of a blade row wherein each blade includes a plurality of acoustic sources.
Figure 4:
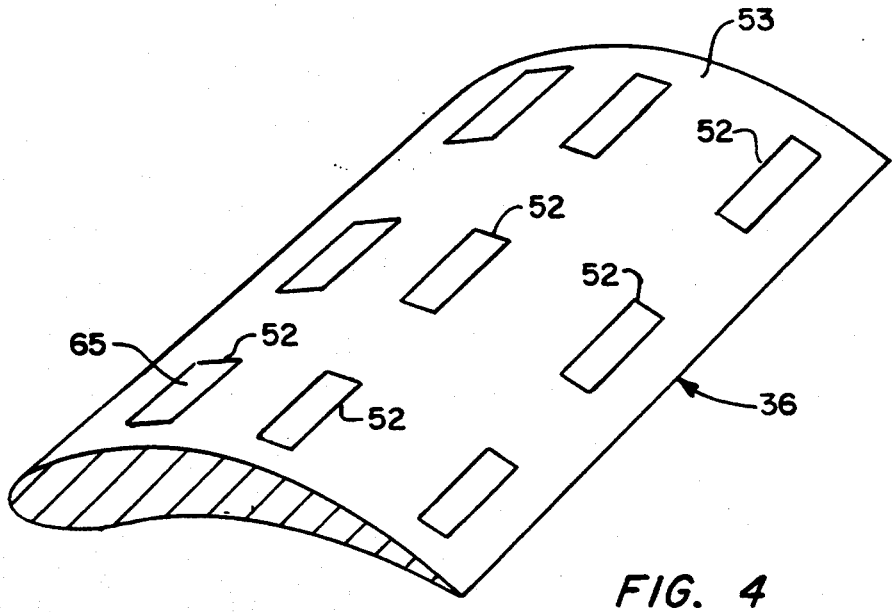
FIG. 4 shows a view of a single blade with a plurality of acoustic sources distributed over the blade's surface.

The present invention is based upon a recognition that cancellation of undesirable noise by means of the use of anti-sound may be best achieved by placing the acoustic sources generating the cancelling sound energy closely adjacent to the location of the noise source. As the noise is generated by the interaction of the downstream blade row 18 with the passing wake velocity fluctuations 48, the present invention locates a plurality of acoustic sources 52 on the exterior surface 53 of the downstream blades 36. FIGS. 4 and 5 show one embodiment of the present invention.

As can be seen by examining FIGS. 4 and 5, a plurality of acoustic sources 52 are arranged on the pressure and suction exterior surfaces of the individual airfoils 36–40. Each source 52 is an individual generator of acoustic waves which is itself mechanically isolated from the mechanical structure of the blades 36–40 wherein the action of the acoustic sources 52 does not impart any significant vibration or produce any significant mechanical interaction with respect to the supporting blades. The sole effect of the operation of the acoustic sources 52 is to generate acoustic sound waves for the cancellation of the tonal noise described hereinabove. The individual sources 52 are actuated and controlled by a controller module 54 which may receive input from microphones 56, 58 located upstream, downstream, or at various other optimal locations relative to the blade rows.

The controller 54 interprets the acoustic noise detected by one or more microphones 56, 58 and generates anti-noise signals 60, 62 which drive the acoustic sources 52. The algorithms and components which may be used in such a controller are well known in the art of noise cancellation. A particular controller 54 would be selected based on a variety of parameters, including, but not limited to, the number of acoustic sources to be controlled, degree of noise cancellation to be achieved, cost, size limitations, etc.

It is critical to the description of the present invention to note that the acoustic sources disposed on the surface of the downstream blades do not act to significantly disrupt or otherwise alter the airflow over the downstream blade cascade, nor do they induce significant vibration, resonance, or any other kind of mechanical movement or activity in the supporting blade structures. The acoustic sources merely act to radiate anti-sound waves into the surrounding gas or airflow thereby cancelling the tonal noise generated by the blade wake interaction at or near its source.

With regard to the particular placement of the sources 52 on the surface of the blades 36–40, computational studies have shown that this effectiveness of noise cancellation is relatively insensitive to the placement of the sources 52, although source surface displacements can be minimized if the acoustic sources are placed in optimal locations on the blade surface. It is thus possible, if desired, to locate this acoustic sources 52 based on structural, cooling, resonance, manufacturing, or other parameters and still achieve nearly total noise cancellation.

Computational studies have also shown that it is possible to achieve complete cancellation of tonal noise if the number of acoustic sources 52 is equal to the number of tonal noise modes generated by the blade wake interaction. Although fewer acoustic sources may be used successfully, the degree of attenuation is not as great as if the full number are used.

Another feature of the present invention is, for acoustic sources having a vibrating surface 65 disposed at the blade surface, a very small displacement of the vibrating surface necessary to produce the desired anti-sound pattern for cancellation of the unwanted tonal noise. Referring again to modeling studies by the inventors, a maximum periodic displacement on the order of 100 microns has been shown to be sufficient to cancel unwanted tonal noise in a typical gas turbine engine compressor arrangement.

Typical acoustic sources 52 driven by a wide variety of actuating means may be used, including, but not limited to, piezoelectric, electrostatic, hydraulic, or any other highly responsive sound generating arrangement.

We claim:

1. In a first blade row and a second blade row, each row including a plurality of individual blades and further having a flow of gas sequentially therethrough, said first and second rows having a relative motion therebetween wherein a plurality of wake velocity variations extending downstream of the individual blades of the first row are periodically encountered by each blade in the second row, the improvement comprising:

a plurality of acoustic sources disposed on an exterior surface of each blade in the second row, each acoustic source located correspondingly similarly on each second row blade.

2. The improvement as recited in claim 1, wherein the acoustic sources disposed on each blade are mechanically isolated therefrom.

3. The improvement as recited in claim 1, wherein each of the acoustic sources includes a vibrating surface in fluid communication with the flow of gas through the first and second rows, and wherein the vibrating surface moves with a vibratory displacement of no greater than $\pm 100$ microns.

4. The improvement as recited in claim 1, wherein the encounter of the second blade row with the plurality of wake velocity variations extending downstream of the individual first row blades generates a multi-modal tonal noise having a number of acoustic tonal noise modes, and wherein the number of acoustic sources disposed on each second row blade is no greater than said number of tonal noise modes.

5. The improvement as recited in claim 1, wherein each active acoustic source is individually driven.

* * * * *